US011406170B1

(12) United States Patent
Fontaine

(10) Patent No.: US 11,406,170 B1
(45) Date of Patent: Aug. 9, 2022

(54) FULLY-FEATURED MINIMALIST BACKPACK

(71) Applicant: Jean-Marc Fontaine, Greenacres, FL (US)

(72) Inventor: Jean-Marc Fontaine, Greenacres, FL (US)

( * ) Notice: Subject to any disclaimer, the term of this patent is extended or adjusted under 35 U.S.C. 154(b) by 312 days.

(21) Appl. No.: 16/054,117

(22) Filed: Aug. 3, 2018

Related U.S. Application Data

(60) Provisional application No. 62/541,654, filed on Aug. 4, 2017.

(51) Int. Cl.
*A45F 3/04* (2006.01)
*A45F 3/14* (2006.01)

(52) U.S. Cl.
CPC ..... *A45F 3/047* (2013.01); *A45F 2003/148* (2013.01)

(58) Field of Classification Search
CPC ..... A45F 3/047; A45F 2003/148
USPC ..... 224/639
See application file for complete search history.

(56) References Cited

U.S. PATENT DOCUMENTS 1,290,827 A * 1/1919 Yergason ..... F42B 39/02 224/623
4,669,127 A 6/1987 Swanson
4,948,023 A * 8/1990 Tripp ..... A45F 3/16 222/175
5,002,270 A 3/1991 Shine
5,333,768 A * 8/1994 Krentz ..... A45F 3/14 224/623
5,657,917 A 8/1997 Johnson et al.
5,692,661 A * 12/1997 Kellerman ..... A45F 5/00 224/646
6,065,658 A * 5/2000 Hashimoto ..... A45F 3/14 224/254
6,295,650 B1 10/2001 Baacke
6,324,697 B1 12/2001 Shofner
6,568,575 B1 * 5/2003 Bartholomew ..... A45F 3/14 224/258
7,490,740 B2 2/2009 Robins et al.
7,738,965 B2 * 6/2010 Phillips ..... A61N 1/3787 607/61
D701,692 S * 4/2014 Heller ..... D3/216
8,833,619 B2 * 9/2014 Chapuis ..... A45F 3/14 224/148.2
9,585,462 B2 * 3/2017 Engdahl ..... A45F 3/10
D813,528 S * 3/2018 Harris ..... D3/215
(Continued)

*Primary Examiner* — Peter N Helvey
(74) *Attorney, Agent, or Firm* — John Rizvi; John Rizvi, P.A.—The Patent Professor®

(57) ABSTRACT

A fully-featured minimalist backpack including a back portion having at least one main pocket, a thoracic strap extending from a bottom of the back portion, and two shoulder straps extending from a top of the back portion. The shoulder straps may each be connected to a front portion of the thoracic strap. The thoracic strap may have one or more pockets. A slot for a personal electronic device may be included in the main pocket. Various configurations for retaining eyeglasses and earphone cables may be included. The thoracic strap may have distal ends that are magnetically attachable to each other. An elastic band may be located between the shoulder straps. One or more secondary or hidden pockets may be included.

16 Claims, 6 Drawing Sheets

(56) References Cited

U.S. PATENT DOCUMENTS

| | | | | |
|---|---|---|---|---|
| 2006/0000856 | A1* | 1/2006 | West | A45F 5/00 224/148.2 |
| 2006/0011690 | A1 | 1/2006 | Bareno | |
| 2006/0218691 | A1 | 10/2006 | Miller | |
| 2007/0226871 | A1 | 10/2007 | Hood | |
| 2010/0205718 | A1 | 8/2010 | Eastep | |
| 2011/0010818 | A1 | 1/2011 | Hood | |
| 2013/0313299 | A1 | 11/2013 | Igwenagu | |

* cited by examiner

FULLY-FEATURED MINIMALIST BACKPACK

FIELD OF THE INVENTION

The present invention relates generally to backpacks and more particularly to a fully-featured minimalist backpack.

BACKGROUND OF THE INVENTION

It is common for backpacks to be used to transport items. In addition to everyday backpacks such as school bags, various specialized backpacks exist, such as camping backpacks or hydration backpacks.

Further, it is common for runners or outdoor sports enthusiasts to use backpacks for storing their personal items such as cell phones or wallets. However, currently available backpack designs are too bulky, uncomfortable, and lack desirable features. For example, conventional backpacks do not prevent objects from moving or shifting while the backpack is being worn during vigorous activities.

Therefore, there exists a need for a backpack that is suited for outdoor sports enthusiasts that is comfortable, fully-featured, and has a low profile.

SUMMARY OF THE INVENTION

This summary is provided to introduce a selection of concepts in a simplified form that are further described below in the detailed description. This summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Disclosed is a backpack, comprising, a back portion including at least one pocket, a thoracic strap extending from a bottom of the back portion, two shoulder straps extending from a top of the back portion, and the shoulder straps each being connected to a front portion of the thoracic strap.

In another aspect, the back portion is configured to fit within an upper back region of a human.

In another aspect, a width of the back portion is substantially less than a length of the back region.

In another aspect, the pocket includes a slot configured to hold a personal electronic device.

In another aspect, the pocket is lined with a liner, and a lining seam of the liner is taped to prevent water from entering the pocket.

In another aspect, the backpack includes two access points for accessing the pocket.

In another aspect, the back portion includes a hidden pocket.

In another aspect, the top of the back portion includes a shell opening for receiving an earphone cable from the pocket.

In another aspect, the thoracic strap includes at least one pocket at the front portion of the thoracic strap.

In another aspect, the thoracic strap includes two ends that are attachable to one another via magnets.

In another aspect, at least one of the shoulder straps includes a loop for retaining an earphone cable.

In another aspect, at least one of the shoulder straps includes an eyewear retainer.

In another aspect, the backpack further comprises an elastic band retainer between the shoulder straps.

Further, disclosed is a backpack, comprising, a back portion including at least one pocket, a thoracic strap extending from a bottom of the back portion, and two shoulder straps extending from a top of the back portion, the shoulder straps each being connected to a front portion of the thoracic strap.

In another aspect, a width of the back portion is less than a length of the back portion.

In another aspect, a width of the back portion at the top of the back portion is greater than the width of the back portion at the bottom of the back portion.

In another aspect, the backpack further comprises an elastic band retainer extending between the shoulder straps.

In another aspect, when the backpack is worn by a human user, the elastic band retainer is located behind a neck of the human user.

In another aspect, the back portion includes a main pocket, the main pocket including a first access point and a second access point.

In another aspect, the first access point includes a first zipper extending horizontally along an outer face surface of the back portion, and the second access point includes a second zipper extending along a top edge of the back portion and a lateral edge of the back portion adjacent to the top edge.

In another aspect, the back portion further includes a secondary pocket located on the back portion.

In another aspect, the back portion includes a main pocket, the backpack further comprising a hidden pocket disposed behind a layer of the main pocket, the hidden pocket being accessible via a concealable zipper.

In another aspect, the back portion includes an opening at the top of the back portion, the opening providing a channel between an exterior of the backpack and the main pocket.

In another aspect, the thoracic strap includes two distal ends that are attachable to each other via a securing configuration.

In another aspect, with the distal ends attached to each other, the thoracic strap forms a continuous loop.

In another aspect, the thoracic strap includes at least one thoracic pocket located at the front portion of the thoracic strap.

In another aspect, the backpack is configured to fit snugly around the body so objects are prevented from moving or shifting during vigorous activities.

In another aspect, included zippers may be noise-free to eliminate rattling noises when running, making the running experience a lot more comfortable.

In another aspect, the thoracic belt may be made out of a carefully chosen elastic band with sufficient retraction forces to keep up to 200 gr from moving in the front pockets when doing vigorous activities.

In another aspect, the angles of the back straps (about 45 degrees) and the pressure of the thoracic belt (retraction force) on the back pack keeps items from moving up and down or sideways.

In another aspect, the load of the objects inserted in the backpack is carried by the friction of the backpack on the back (due to the retraction forces of the upper straps and thoracic belt) more than the straps.

In another aspect, because of the retraction forces of the upper straps and thoracic belt, users do not feel the weight of the objects they carry, making the vigorous activity a lot more comfortable than traditional packs.

In another aspect, the position on the body of the thoracic belt is configured to provide accessible pockets where hands naturally pass by to store and retrieve personal items without affecting running forms.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration," Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
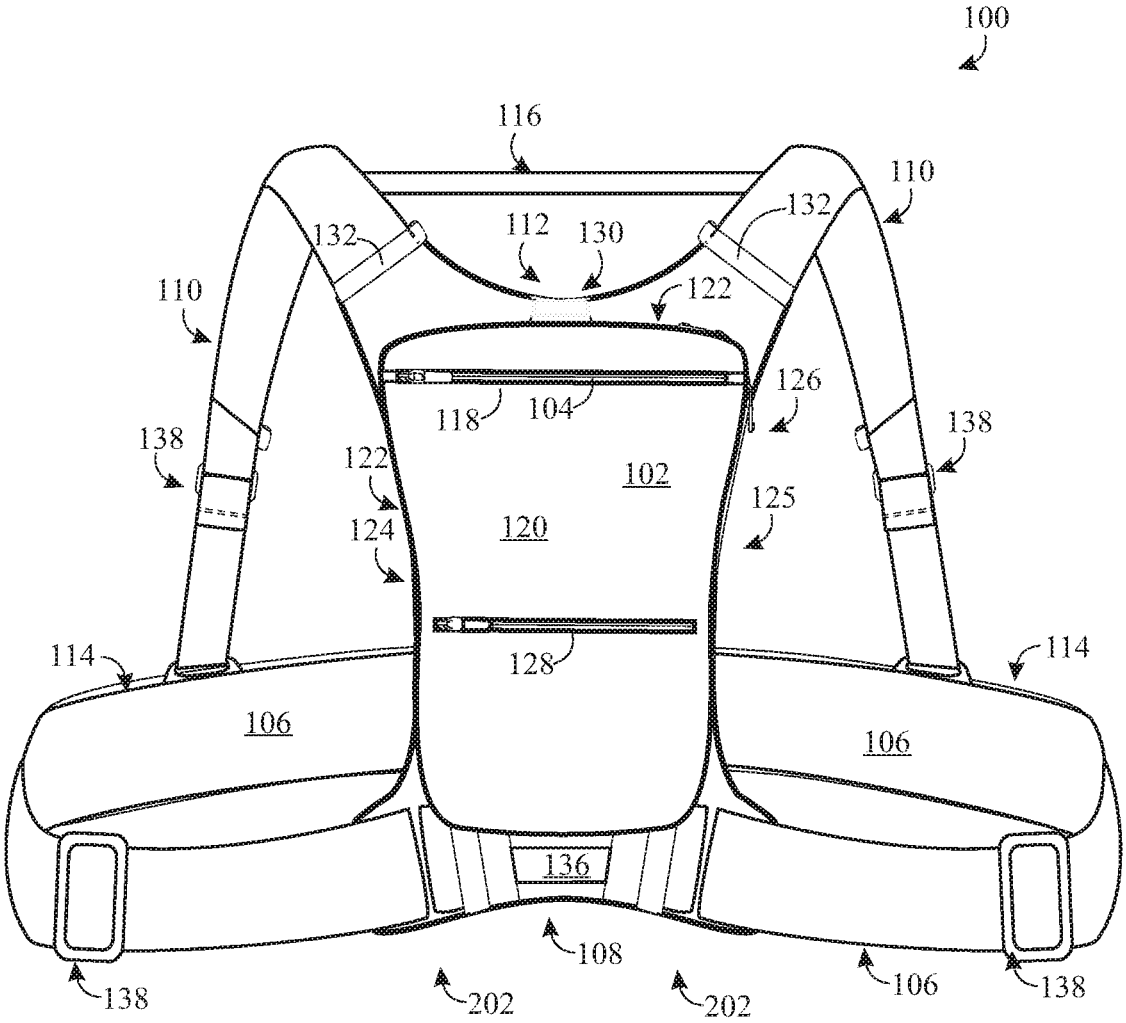
FIG. 2 presents a back view of the backpack, in accordance with aspects of the present disclosure.

As shown throughout the figures, disclosed is a fully-featured minimalist backpack 100. As shown in FIG. 2, the backpack 100 may include a back portion 102 including at least one main pocket 104, a thoracic strap 106 extending from a bottom 108 of the back portion 102, and two shoulder straps 110 extending from a top 112 of the back portion 102. The shoulder straps 110 may each be connected to a front portion 114 of the thoracic strap 106.

Figure 6:
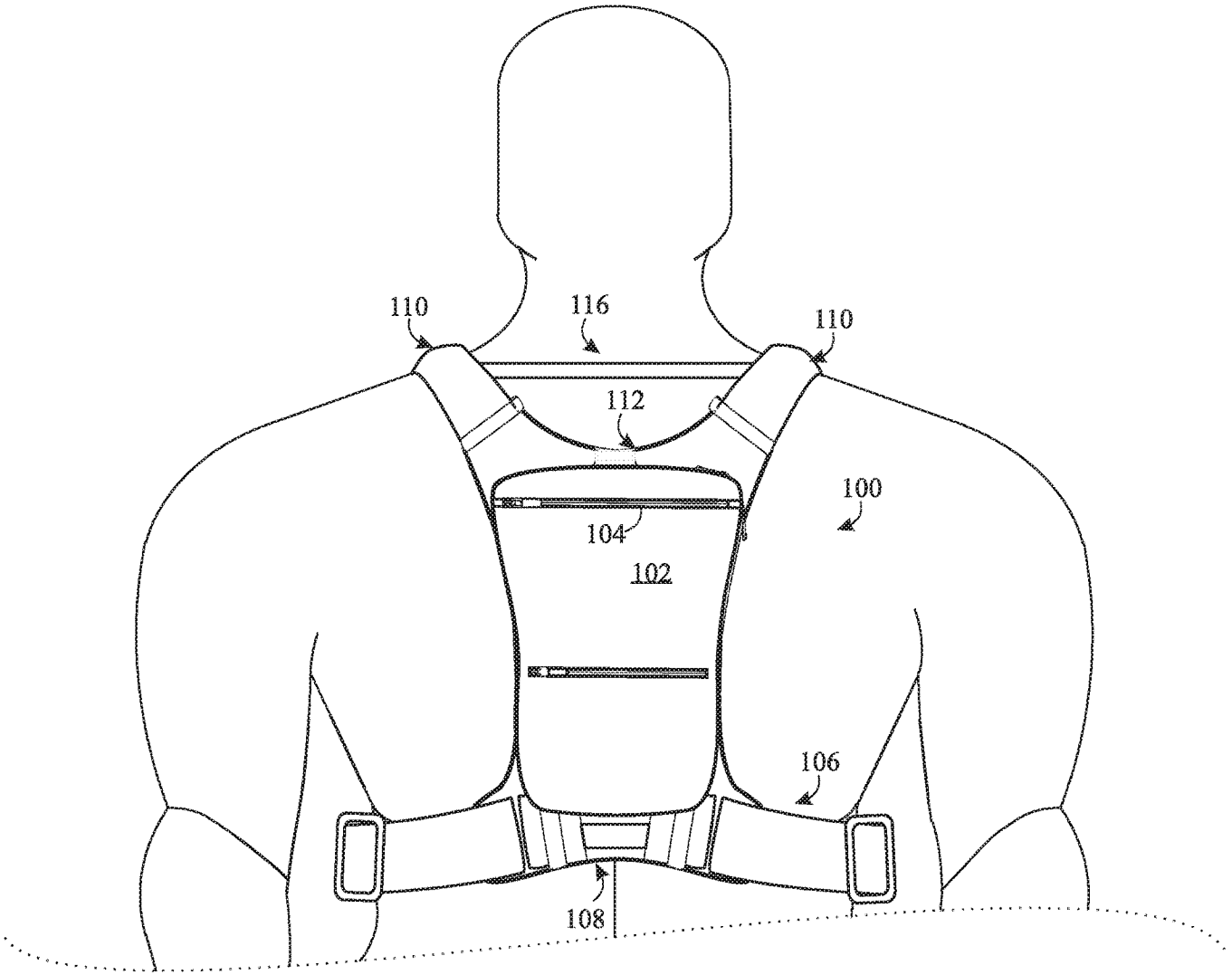
FIG. 6 presents a back view of the user wearing the backpack, in accordance with aspects of the present disclosure.

The back portion 102 may be configured to fit completely within an upper back region of a human, as shown in FIG. 6, without substantially covering or touching the lower back. This form factor provides optimal range of motion to the user's shoulder blades, and reduces sway of the backpack 100 during running. In other words, the backpack 100 may generally be configured to be worn on an upper body, and not a lower body, of a human user. As shown in FIG. 6, a width of the back portion 102 may be substantially less than a length of the back portion 102. As a non-limiting example, the length of the back portion 102 may be approximately between 200-240 mm. A maximum width of the back portion 102 may be between 100-150 mm. Thus, in some non-limiting examples a ratio of the length of the back portion 102 to the width of the back portion may be greater than or equal to 2. As shown in FIG. 2, the back portion 102 may have a greater width at the top 112 of the back portion 102 than near a bottom 108 of the back portion 102. The herein disclosed measurements may vary by an appropriate amount without departing from the scope and spirit of the disclosure.

The backpack 100 may further include an elastic band retainer 116 extending between the shoulder straps 110. For example, the elastic band retainer 116 may provide an inward tension forcing a top of the shoulder straps 110 together. This configuration keeps the shoulder straps 110 from sliding off the user's shoulders, and keeps the backpack 100 tight against the user's back. As shown in FIG. 6, the elastic band retainer 116 is located behind a human user's neck while the backpack 100 is worn.

Figure 7:
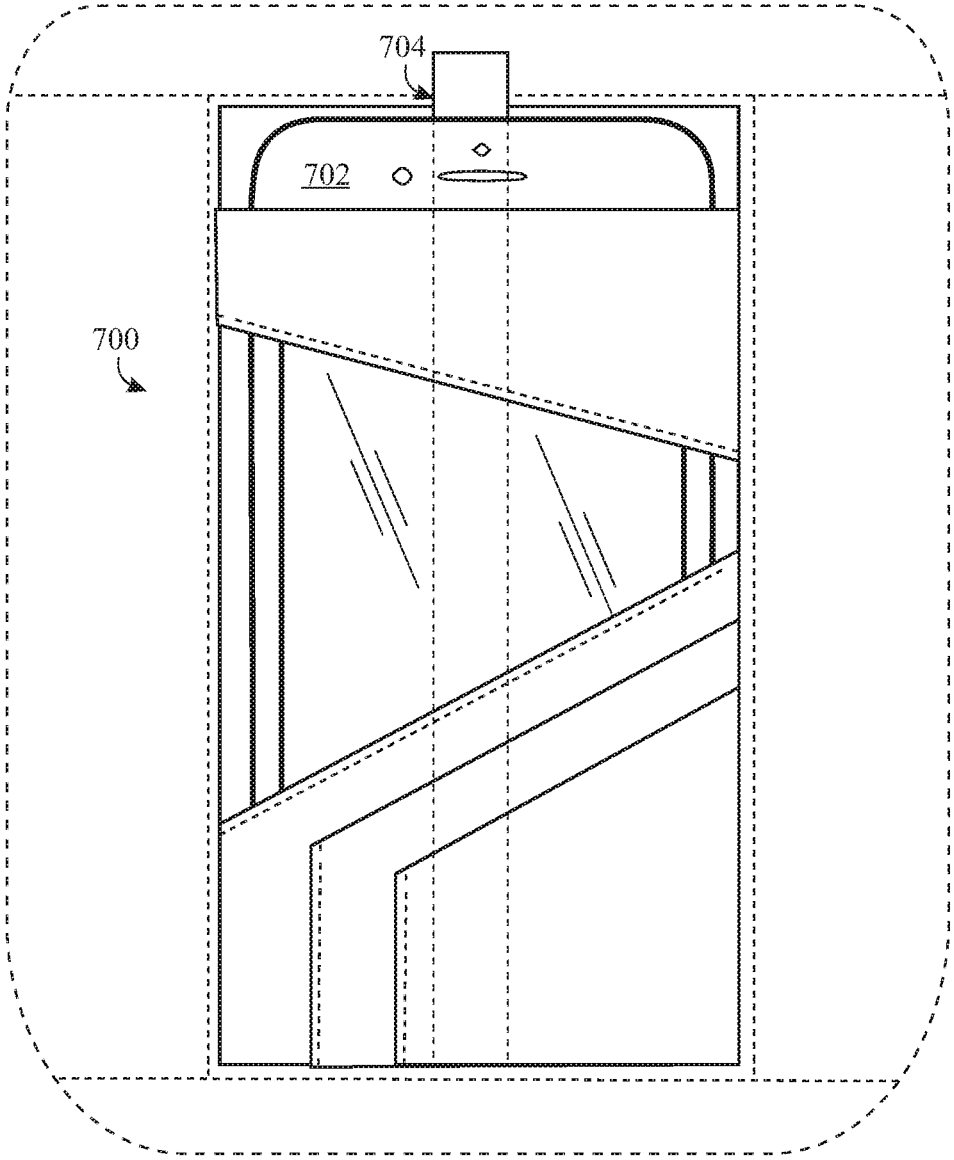
FIG. 7 presents a slot for a personal electronic device; in accordance with aspects of the present disclosure.

As shown in FIG. 7, the main pocket 104 may include a slot 700 configured to hold a personal electronic device 702. For example, the slot 700 may be configured to tightly fit a smart phone. Running tape 704 may be stored in the slot 700 and/or the main pocket 104. The slot 700 may include variously sized slots for variously sized devices and items.

The main pocket 104 may be lined with a waterproof liner, and a lining seam of the liner may be taped for preventing water from entering the main pocket 104. Any of the herein pockets may be lined as such.

The back portion 102 may include two access points for accessing the main pocket 104. A first access point 118 may be a first zippered access point 118 at an outer face surface 120 of the back portion 102. A second access point may be a second zippered access point 122 located on a side 124 of the back portion 102. Thus the first access point 118 may include a horizontal zipper at the outer face surface 120 of the back portion 102 (e.g., a zipper extending horizontally along the outer face surface), and the second access point 122 may be at least partially vertical along a side surface 124 of the back portion 102. The second access point 122. may extend along adjacent top and side edges (lateral sides) of the back portion 102, such that its zipper forms a general L-shape at a corner of the back portion 102.

The back portion 102 may include a hidden pocket. For example, the hidden pocket may include or be accessed via a hidden or concealable zipper 126. The hidden pocket may be disposed behind a layer of the main pocket 104, and may be accessible from an opposite side surface 125 of the back portion 102 relative to the second zippered access point 122 of main pocket 104.

Furthermore, a zippered secondary pocket 128 may be located in the back portion 102 such that the secondary pocket 128 is accessible from its own opening on the outer face surface 120. The secondary pocket 128 may have its own zipper as shown in FIG. 2.

The top 112 of the back portion 102 may include an opening 130 for receiving an earphone cable from the main pocket 104. For example, the opening 130 may be a fabric that is biased closed, so that an earphone cable originating from the main pocket 104 may be fed and held through the opening 130 while preventing debris or water entering the main pocket 104 through the opening 130. Generally, the opening 130 provides a channel between the exterior of the backpack and the main pocket 104, through which any suitable objects may be routed.

As shown in FIG. 2, the thoracic strap 106 may include a first portion (e.g., left portion) and a second portion (e.g., right portion) that extend laterally, at proximal ends 202, from the back portion 102. Conversely, the shoulder straps 110 may extend approximately vertically downward along the backpack 100, from proximal ends at the top 112 of the back portion 102 to the thoracic strap 106, where the distal ends of the shoulder straps attach to the thoracic strap at a lower end of the shoulder straps. For example, at least a portion of the shoulder straps 110 may be approximately perpendicular to, or at an oblique angle relative to, the first and second portions of the thoracic strap 106.

Figure 3:
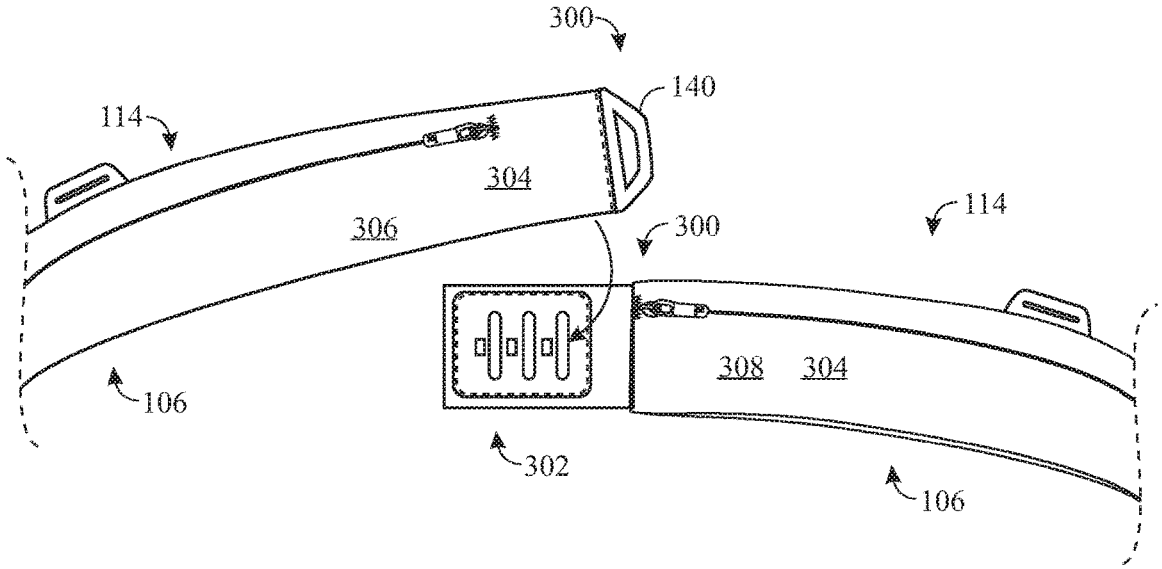
FIG. 3 presents a thoracic strap being secured, in accordance with aspects of the present disclosure.
Figure 4:
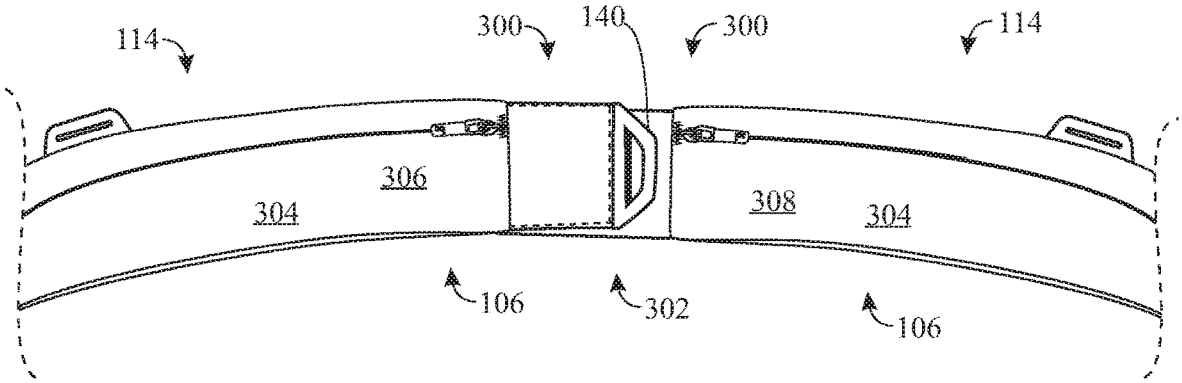
FIG. 4 presents a thoracic strap having been secured, in accordance with aspects of the present disclosure.
Figure 5:
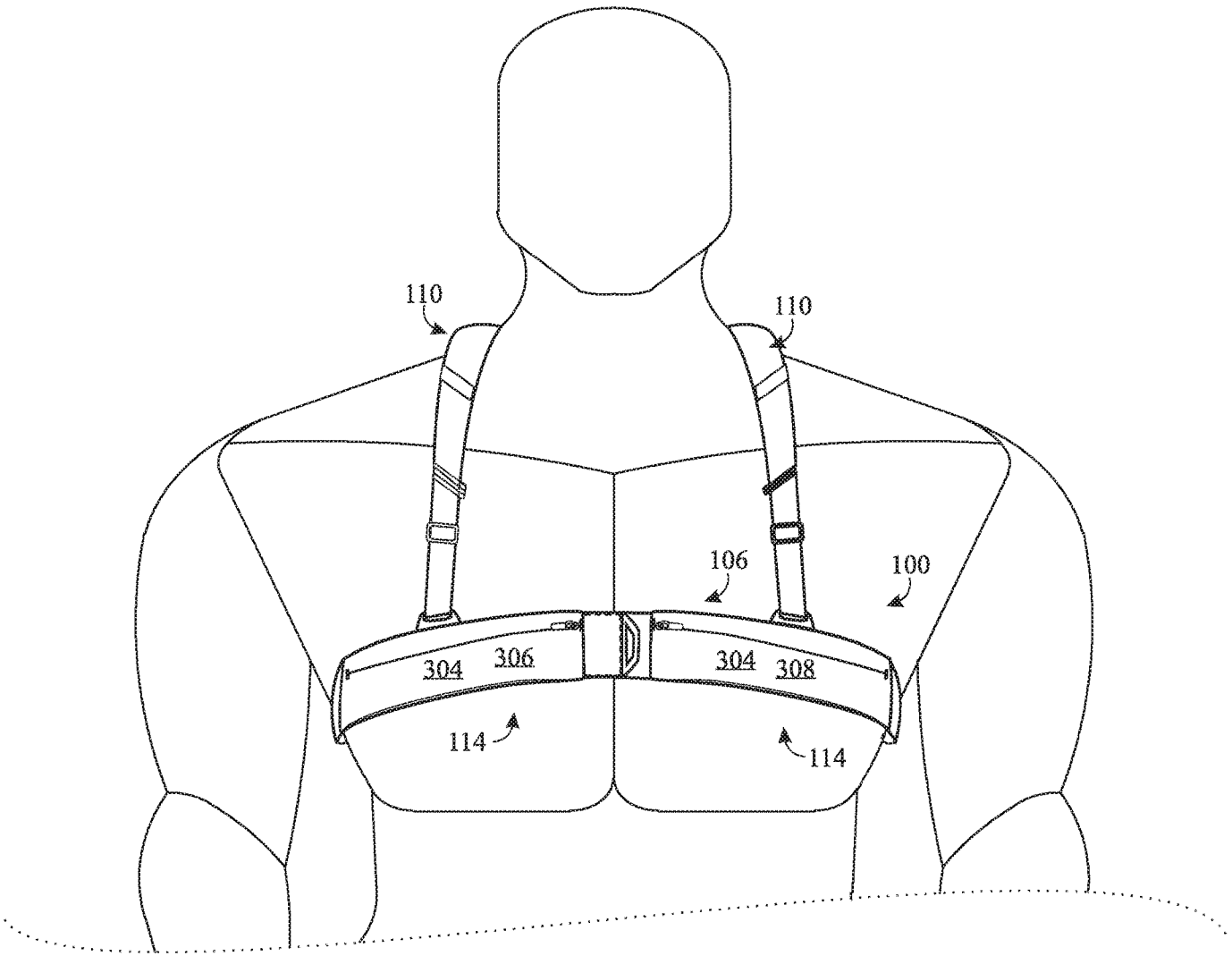
FIG. 5 presents a front view of a user wearing the backpack, in accordance with aspects of the present disclosure.

As shown in FIG. 3, the thoracic strap 106 may include two ends 300 (i.e. respective distal ends of the first and second portions) that are attachable to one another via a securing configuration 302. The thoracic strap 106 secures around a user's chest as shown in FIG. 5 such that the ends 300 connect at a center of the chest. However, it is to be understood that the ends 300 may connect at any appropriate location, such as to the side to allow location of frontal LED lights. The securing configuration 302 may include magnetic components to magnetically secure the ends of the thoracic strap 106 together. Each end 300 may include one or more magnets for magnetically coupling the ends 300 together. Any appropriate securing configuration may be included to secure the ends 300 together. With the ends 300 connected together, the thoracic strap 106 may form a continuous loop.

Figure 1:
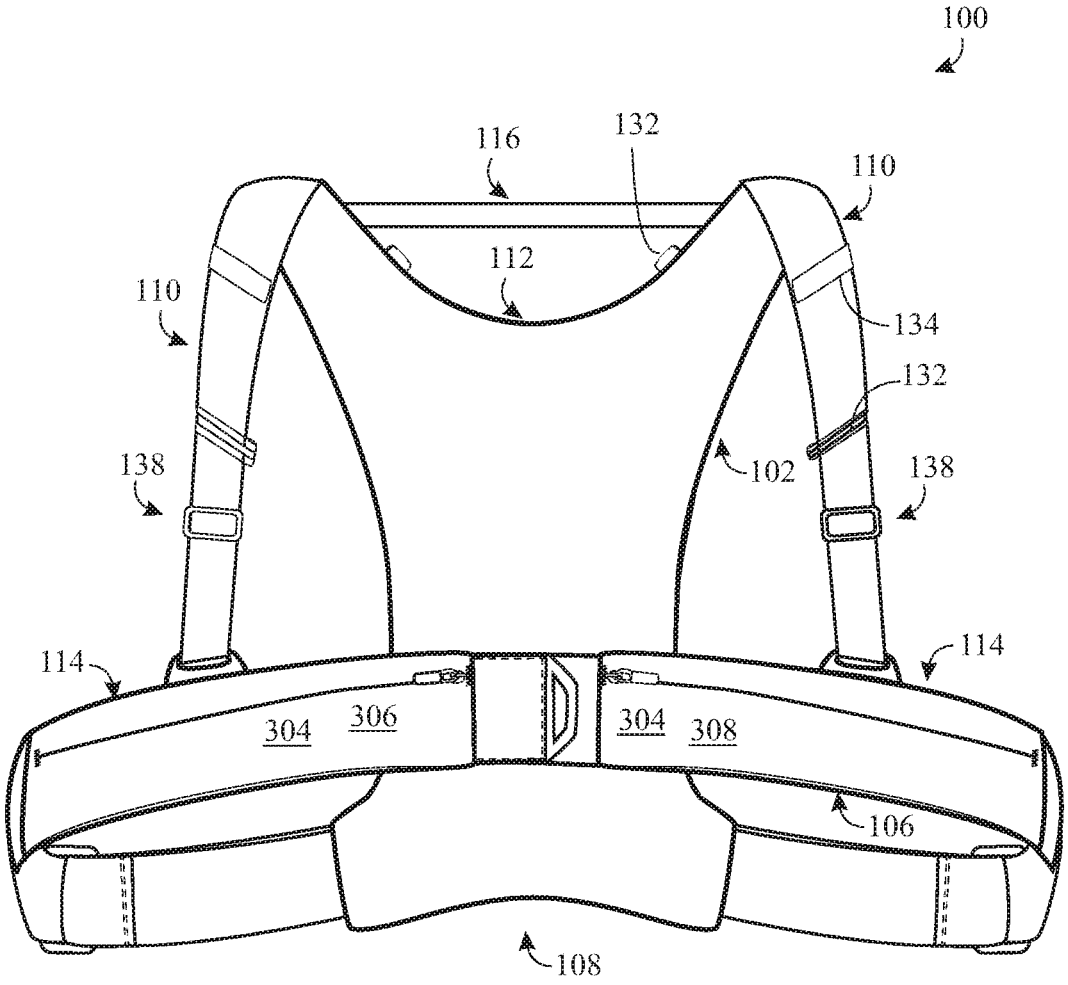
FIG. 1 presents a front view of a backpack, in accordance with aspects of the present disclosure.

As shown in FIG. 1, the thoracic strap 106 may include at least one thoracic pocket 304 at the front portion 114 of the thoracic strap 106. For example, as shown in FIG. 1, two thoracic pockets 304 may be located at the front portion 114 of the thoracic strap 106. The thoracic pockets 304 of the thoracic strap may be zippered as shown in FIG. 1. A first thoracic pocket 306 may be located on a first side of the securing configuration 302 (e.g. left side) and a second thoracic pocket 308 may be located on a second side of the securing configuration 302 (e.g. right side), The thoracic pockets 304 may longitudinally extend along the front portion 114 of the thoracic strap 106, and may be configured to hold personal items such as a smart phone. It is to be understood that the front portion 114 of the thoracic strap may be an entire front portion of the thoracic strap in front of a waist of a user when the backpack 100 is worn. The thoracic pockets may face any appropriate direction (e.g. inward, upward, outward).

As shown in FIG. 1, at least one of the shoulder straps 110 may include a loop 132 for retaining an earphone cable coming out of the opening 130. Further, at least one of the shoulder straps 110 may include an eyewear retainer 134 for holding eyewear such as eyeglasses or sunglasses. The eyewear retainer 134 and the loop 132 may be elastically biasable. A plurality of loops 132 may be included as shown in FIGS. 1 and 2.

Various materials and configurations may be included to provide comfort to a user. For example, an elastic material webbing 136 may be located between two proximal ends 202 of the thoracic strap where the strap attaches to the back portion 102. Various sliplock configurations 138 may be included to adjust lengths of any of the herein disclosed straps. One or more portions of the herein disclosed straps may include elastic materials, and/or be removable or replaceable. One or more portions of the disclosed backpack 100 may include ultralight nylon (cordura), duraflex, quick dry wicking double knit fabric, plain webbing, reflective materials, ducksan, shell fabric, antimicrobial wicking comfort air mesh, hypalon, VELEX, and/or Onestar materials. A portion of the shoulder straps that connect to the thoracic strap may be elastic.

Further, it is to be understood that the securing configuration may include FIDLOCK Magnet configurations, and a puller 140 that allows a user to pull the ends 300 apart. Any of the zippers may be any appropriate zipper, such as YKK Tender touch #3 zippers.

In conclusion, disclosed is a fully-featured minimalist backpack for exercise enthusiasts. The backpack may have two parts: a front part where a user may store what the user could need during a vigorous activity, and a back part where the user may store what the user does not need while the user runs but wants to take with them (money, insurance card, cell phone, a map, etc.)

Below is a table (Table 1) showing non-limiting examples where objects may be located on the backpack.

TABLE 1

| | Front pockets | Back pockets | | |
|---|---|---|---|---|
| Items list | 2 small | 1 main | 2 medium | 1 secret |
| Cell phone up to (5.5") | Yes | Yes | No | Yes |
| Any Cell phone | No | Yes | No | Yes |
| House keys | Yes | Yes | Yes | Yes |
| Car keys | Yes | Yes | Yes | Yes |
| ID card | Yes | Yes | Yes | Yes |
| Insurance card | Yes | Yes | Yes | Yes |
| Wallet | No | Yes | No | Yes |
| Money | Yes | Yes | Yes | Yes |
| Loose change | Yes | Yes | Yes | Yes |
| Credit card | Yes | Yes | Yes | Yes |
| Hotel card | Yes | Yes | Yes | Yes |
| Gel | Yes | Yes | Yes | Yes |
| Endurolytes, salt tablets | Yes | Yes | Yes | Yes |
| Passeport | No | Yes | No | Yes |
| Reading glasses | Yes | Yes | No | Yes |
| Sunglasses | Yes | Yes | No | Yes |
| Small Jug - Flask | Yes | Yes | No | Yes |
| Lip balm | Yes | Yes | Yes | Yes |
| Handkerchief | Yes | Yes | Yes | Yes |
| Paper tissue | Yes | Yes | Yes | Yes |
| Toilet paper | Yes | Yes | Yes | Yes |
| Pocket knife | Yes | Yes | Yes | Yes |
| Deodorant stick | Yes | Yes | No | Yes |
| Collapsable Hat | No | Yes | No | No |
| Small scarf | No | Yes | No | No |
| Sunscreen travel size | Yes | Yes | No | Yes |
| Small flashlight | No | Yes | No | Yes |
| Headlamp | No | Yes | No | Yes |
| Tshirt | No | Yes | No | No |
| Pepper spray | Yes | Yes | No | Yes |
| Gum, candy | Yes | Yes | Yes | Yes |
| Glass case soft shell | Yes | Yes | No | Yes |
| Bracelets | Yes | Yes | Yes | Yes |
| Feminine products | Yes | Yes | Yes | Yes |
| Ear buds | Yes | Yes | Yes | Yes |
| Blister patches | Yes | Yes | Yes | Yes |
| Pen - pencil - highlighter | No | Yes | No | Yes |
| Small gloves | No | Yes | No | Yes |

TABLE 1-continued

| | Front pockets | Back pockets | | |
|---|---|---|---|---|
| Items list | 2 small | 1 main | 2 medium | 1 secret |
| Business cards | Yes | Yes | Yes | Yes |
| Flash drive | Yes | Yes | Yes | Yes |
| Prescription drugs | Yes | Yes | Yes | Yes |
| Inhaler (asthma) | Yes | Yes | No | Yes |
| Diabete emergency kit | No | Yes | No | Yes |
| Small sewing kit | Yes | Yes | Yes | Yes |

The backpack is configured to fit snugly around the body so objects are prevented from moving or shifting during vigorous activities. Any of the zippers may have noise-free zipper tabs to eliminate rattling noises when running, making the running experience a lot more comfortable.

The thoracic belt may be made out of a carefully chosen elastic band with sufficient retraction forces to keep up to 200 gr from moving in the front pockets when doing vigorous activities.

The angles of the back straps (about 45 degrees) and the pressure of the thoracic belt (retraction force) on the back pack keeps items from moving up and down or sideways. The load of the objects inserted in the backpack are carried by the friction of the backpack on the back (due to the retraction forces of the upper straps and thoracic belt) more than a hanging force on the straps. Typical backpack loads are carried by upper straps, which is not the case for the disclosed invention. Because of the retraction forces of the upper straps and thoracic belt, users do not feel the weight of the objects they carry, making the vigorous activity a lot more comfortable than traditional packs.

The position on the body of the thoracic belt is very important. When a person runs, hands naturally swing by the sub-pectoral region at every stride. Having accessible pockets where hands naturally pass by is a biomechanically ideal location to store and retrieve personal items without affecting running forms.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A backpack operatively positionable about a user's back configured to fit snugly around the user's body to prevent objects stored therein from moving or shilling around while the user is engaged in vigorous activities, said backpack comprising:

a back portion having a top, a bottom and oppositely disposed sides, and including at leas one pocket;

two shoulder straps extending from opposite ends of the top of the back portion, a thoracic strap is defined to include a left first portion and a right second portion that each extend horizontally outward from a different one of the oppositely disposed sides of an elastic material webbing attached adjacent the bottom of the back portion to further stabilize the backpack while the backpack is operatively positioned about the user's back and to provide comfort to the user wearing the backpack;

the shoulder straps are defined to extend approximately vertically downward along opposite sides of the user's chest from proximal ends at the top of the back portion to the thoracic strap, the distal end of each shoulder strap attached to a different one of the left first portion and the right second portion of the thoracic strap at a lower end thereof, such that the shoulder straps are disposed substantially perpendicular to the thoracic strap, wherein the shoulder straps further stabilize the backpack while the backpack is operatively positioned about the user's back;

an elastic band retainer extending between uppermost portions of the shoulder straps and across the back of the neck of the user provides an inward tension forcing the uppermost portion of each shoulder strap towards one another to prevent the shoulder straps from sliding off the user's shoulders and to maintain the backpack snug against the user's back so as to prevent shifting thereof; and the thoracic strap having at least one thoracic pocket located in one of the left first portion or the right second portion, wherein the at least one thoracic pocket extends longitudinally along a front portion of the thoracic strap to facilitate access thereinto while the backpack is operatively positioned about the user's back.

2. The backpack of claim 1, wherein a width of the back portion is less than a length of the back portion.

3. The backpack of claim 1, wherein a width of the back portion at the top of the back portion is greater than the width of the back portion at the bottom of the back portion.

4. The backpack of claim 1, wherein the back portion includes a main pocket, the main pocket including a first access point and a second access point.

5. The backpack of claim 4, wherein the first access point includes a first zipper extending horizontally along an outer face surface of the back portion, and the second access point includes a second zipper extending along a top edge of the back portion and a lateral edge of the back portion adjacent to the top edge.

6. The backpack of claim 4, wherein the back portion further includes a secondary pocket located on the back portion.

7. The backpack of claim 1, wherein the back portion includes a main pocket, the backpack further comprising a hidden pocket disposed behind a layer of the main pocket, the hidden pocket being accessible via a concealable zipper.

8. The backpack of claim 1, wherein the back portion further comprises an opening constructed of a fabric that is biased closed while permitting an earphone cable originating in the main pocket to pass therethrough and be held in place through the opening.

9. The backpack of claim 1, wherein the thoracic strap includes two distal ends that are attachable to each other via a securing configuration.

10. The backpack of claim 9, wherein, with the distal ends attached to each other, the thoracic strap forming a continuous loop.

11. The backpack of claim 10, wherein the thoracic strap includes at least one thoracic pocket located in each of the left first portion and the right second portion, wherein each thoracic pocket is positioned to facilitate access thereinto while the backpack is operatively positioned about the user's back.

12. A minimalist backpack operatively positionable about a user's back configured to fit snugly around the user's body to prevent objects stored therein from moving or shifting around while the user is engaged in vigorous activities, said backpack comprising:

a back portion having a top, a bottom and oppositely disposed sides, and including one or more pockets;

first and second shoulder straps extending from opposite ds of the top of the back portion;

a thoracic strap is defined to include a left first portion and a right second portion that each extend horizontally outward from a different one of the oppositely disposed sides of an elastic material webbing attached adjacent the bottom of the back portion, the thoracic strap provided to further stabilize the backpack while the backpack is operatively positioned about the user's back and to provide comfort to the user wearing the backpack;

the shoulder straps are defined to extend approximately vertically downward along opposite sides of the user's chest from proximal ends at the top of the back portion to the thoracic strap, the distal end of each shoulder strap attached to a different one of the left first portion and the right second portion of the thoracic strap at a lower end thereof, such that the shoulder straps are disposed substantially perpendicular to the thoracic strap while the backpack is operatively positioned about the user's back;

an elastic band retainer extending between uppermost portions of the shoulder straps and across the back of the neck of the user provides an inward tension forcing the uppermost portion of each shoulder strap towards one another to prevent the shoulder straps from sliding off the user's shoulders and to maintain the backpack snug against the user's hack so as to prevent shifting thereof; and the thoracic strap having at least one thoracic pocket located in each of the left first portion and the right second portion, wherein each thoracic pocket extends longitudinally along a front portion of the corresponding thoracic strap to facilitate access thereinto while the backpack is operatively positioned about the user's back.

13. The minimalist backpack of claim 12, wherein a ratio of a length of the back portion to a width of the back portion is greater than or equal to 2.

14. The minimalist backpack of claim 12, wherein the one or more pockets include a main pocket including a first access point and a second access point, the first access point includes a first zipper extending horizontally along an outer face surface of the back portion, and the second access point includes a second zipper forming an L-shape at a corner of the back portion.

15. The minimalist backpack of claim 12, wherein a width of the back portion at the top of the back portion is greater than the width of the back portion at the bottom of the back portion, the back portion includes a main pocket, a secondary pocket, and a hidden pocket disposed behind a layer of the main pocket, the hidden pocket being accessible via a concealable zipper, and the first and second portions of the thoracic strap include respective distal ends that are attachable to each other via a securing configuration.

16. A fully-featured minimalist backpack operatively positionable about a user's back configured to fit snugly around the user's body to prevent objects stored therein from moving or shifting around while the user is engaged in vigorous activities, said backpack comprising:

a back portion having a top, a bottom and oppositely disposed sides, and including a main pocket and a secondary pocket, the main pocket and secondary pocket including respective zippers;

the back portion further comprises an opening constructed of a fabric that is biased closed while permitting an earphone cable originating in the main pocket to extend therethrough and be held in place through the opening;

left and right shoulder straps extending downwardly from the top of the back portion, at least one of the shoulder straps including a loop to retain the earphone cable extending out of the opening;

an elastic band retainer extending between uppermost portions of the shoulder straps and across the back of the neck of the user provides an inward tension forcing the uppermost portion of each shoulder strap towards one another to prevent the shoulder straps from sliding off the user's shoulders and to maintain the backpack snug against the user's back so as to prevent shifting thereof;

a thoracic strap is defined to include a left first portion and a right second portion that each extend horizontally outward from a different one of the oppositely disposed sides of an elastic material webbing attached adjacent the bottom of the back portion, the thoracic strap provided to further stabilize the backpack while the backpack is operatively positioned about the user's back and to provide comfort to the user wearing the backpack;

the shoulder straps are defined to extend approximately vertically downward along opposite sides of the user's chest from proximal ends at the top of the back portion to the thoracic strap, the distal end of each shoulder strap attached to a different one of the left first portion and the right second portion of the thoracic strap at a lower end thereof, such that the shoulder straps are disposed substantially perpendicular to the thoracic strap while the backpack is operatively positioned about the user's back; and the thoracic strap having at least one thoracic pocket located in each of the left first portion and the right second portion, wherein each thoracic pocket extends longitudinally along a front portion of the corresponding thoracic strap to facilitate access thereinto while the backpack is operatively positioned about the user's back.

* * * * *